US005081945A

United States Patent [19]

Bozoglou

[11] Patent Number: 5,081,945

[45] Date of Patent: Jan. 21, 1992

[54] ELASTIC TAPE SEWING MACHINE

[75] Inventor: Pantelis Bozoglou, Olching, Fed. Rep. of Germany

[73] Assignee: Juki Corporation, Tokyo, Japan

[21] Appl. No.: 368,330

[22] PCT Filed: Dec. 27, 1988

[86] PCT No.: PCT/JP88/01339

§ 371 Date: Jun. 5, 1989

§ 102(e) Date: Jun. 5, 1989

[87] PCT Pub. No.: WO90/07603

PCT Pub. Date: Jul. 12, 1990

[51] Int. Cl.[5] ..... D05B 35/06

[52] U.S. Cl. ..... 112/121.26; 112/152; 112/305

[58] Field of Search ..... 112/121.26, 121.27, 112/130, 152, 305

[56] References Cited

U.S. PATENT DOCUMENTS

| | | | |
|---|---|---|---|
| 2,907,289 | 10/1959 | Fernandez | 112/121.26 |
| 4,024,824 | 5/1977 | Haff, Jr. | 112/121.26 |
| 4,281,608 | 8/1981 | Mitani et al. | 112/121.26 X |
| 4,635,575 | 1/1987 | Schips | 112/121.26 |
| 4,649,839 | 3/1987 | Schneckenburger | 112/121.26 |

FOREIGN PATENT DOCUMENTS

| | | | |
|---|---|---|---|
| 152090 | 1/1952 | Australia | 112/152 |
| 1406075 | 6/1965 | France | 112/152 |
| 20029 | 5/1985 | Japan | 112/254 |
| 20030 | 5/1985 | Japan | 112/254 |

*Primary Examiner*—Werner H. Schroeder
*Assistant Examiner*—Paul C. Lewis

[57] ABSTRACT

The elastic tape sewing machine comprises feed teeth feeding a combined body of a fabric and an elastic tape, a sewing needle sewing the elastic tape on the fabric, a presser foot including an elastic tape through-hole and movable to and from said feed teeth to hold the combined body of the fabric and the elastic tape with the feed teeth, a supply device including a retaining means retaining the elastic tape utilizing spring force of an elastic body and feeding the elastic tape through the elastic tape through-hole to one side of the presser foot opposing the feed teeth, a guide device guiding the elastic tape fed from the supply device to a sewing-ready position between the presser foot and the feed teeth, and a cutting device to cut the elastic tape, characterized in that said retaining means includes a regulating apparatus formed by a regulating mechanism having a motor rotating predetermined angle by an electric signal to regulate the spring force of the elastic body and a controller controlling the rotation angle of the motor.

6 Claims, 3 Drawing Sheets

ELASTIC TAPE SEWING MACHINE

BACKGROUND OF THE INVENTION

1. Field of the Invention

The present invention relates to an improvement of a sewing machine to sew an elastic tape to a fabric.

2. Description of the Prior Art

A generally known elastic tape sewing machine is adapted to place a sewing portion of an elongated elastic tape to be sewn on a fabric, to retain the combined body of the elastic tape and the fabric between feed teeth and a presser foot opposed to the feed teeth, to feed the combined body by the feed teeth and to sew the elastic tape by a sewing needle to the fabric. In this case, the elastic tape is supplied from a tape winding bobbin through a through hole in the presser foot to space between the feed teeth and the presser foot.

Conventionally, in such a sewing machine, the elastic tape to be sewn is fed to have suitable tension on the fabric. Thus, in the course of the elastic tape from the bobbin to the presser foot, the elastic tape is passed between a pair of retaining members pressing the elastic tape. The retaining members are adapted to press the elastic tape by urging a movable retaining member onto a fixed retaining member by the force of a spring.

However, such retaining members can not adjust the force of the spring automatically and precisely. To apply suitable tension to the elastic tape, an adjusting screw may be manually turned on the fixed retaining member to compress the spring inserted between the movable retaining member and the adjusting screw so as to adjust the spring force. That is troublesome and time consuming problem.

SUMMARY OF THE INVENTION

The object of the present invention is to provide an elastic tape sewing machine which has a mechanism to regulate the spring force of a spring means automatically in order to apply suitable tension to the elastic tape.

To attain the above mentioned object, an elastic tape sewing machine includes feed teeth for feeding a combined body of a fabric and an elastic tape, a sewing needle sewing the elastic tape onto the fabric, a presser foot including an elastic tape through hole and movable to and from said feed teeth to hold the combined body of the fabric and the elastic tape with the feed teeth, a supply device including a retaining means retaining the elastic tape utilizing spring force of an elastic body and feeding the elastic tape through the elastic tape through hole to one side of the presser foot opposing the feed teeth, a guide device guiding the elastic tape fed from the supply device to sewing-ready position between the presser foot and the feed teeth, and a cutting device to cut the elastic tape, characterized by said retaining means including a regulating apparatus formed by a regulating mechanism having a motor rotating predetermined angle set by electric signal to regulate the spring force of the elastic body and a controller controlling the rotation angle of the motor.

Accordingly, by controlling the rotation angle of the motor by the controller, the spring force of the spring body, i.e., elastic tape retaining force of the elastic body, can be precisely regulated so that conventional troublesome manual adjustment is completely eliminated, and suitable tension can be applied to the elastic tape now to be used.

The motor of the regulating apparatus may preferably be a stepper motor. For example, a pulse motor or inclemental motor can be used as the motor for regulating apparatus.

According to other features of the present invention, an elastic tape sewing machine having feed teeth feeding a combined body of a fabric and an elastic tape, a sewing needle sewing the elastic tape onto the fabric, a presser foot including an elastic tape through-hole and movable to and from said feed teeth to hold the combined body of the fabric and the elastic tape with the feed teeth, a supply device including a retaining means retaining the elastic tape utilizing the spring force of an elastic body and feeding the elastic tape through the elastic tape through-hole to one side of the presser foot opposing the feed teeth, a guide device guiding the elastic tape fed from the supply device to a sewing-ready position between the presser foot and the feed teeth, and a cutting device to cut the elastic tape, characterized by said retaining means including a regulating apparatus formed by a regulating mechanism having an intermittent motion mechanism intermittently linear or rotational moving to regulate the spring force of the elastic body and a controller controlling the amount of the linear or rotational movement of the intermittent motion mechanism.

Accordingly, by controlling the amount of the intermittent movement of the intermittent motion mechanism, the spring force of the elastic body, i.e. elastic tape retaining force by the elastic body, can be precisely regulated, so that the conventional troublesome manual operations are completely eliminated, and suitable tension can be applied to the elastic tape.

BRIEF DESCRIPTION OF THE DRAWINGS

FIG. 4 is enlarged partial sectional views of a presser foot to show a cutting device.

BEST MODE FOR CARRYING-OUT THE INVENTION

Figures 1, 2, 3:
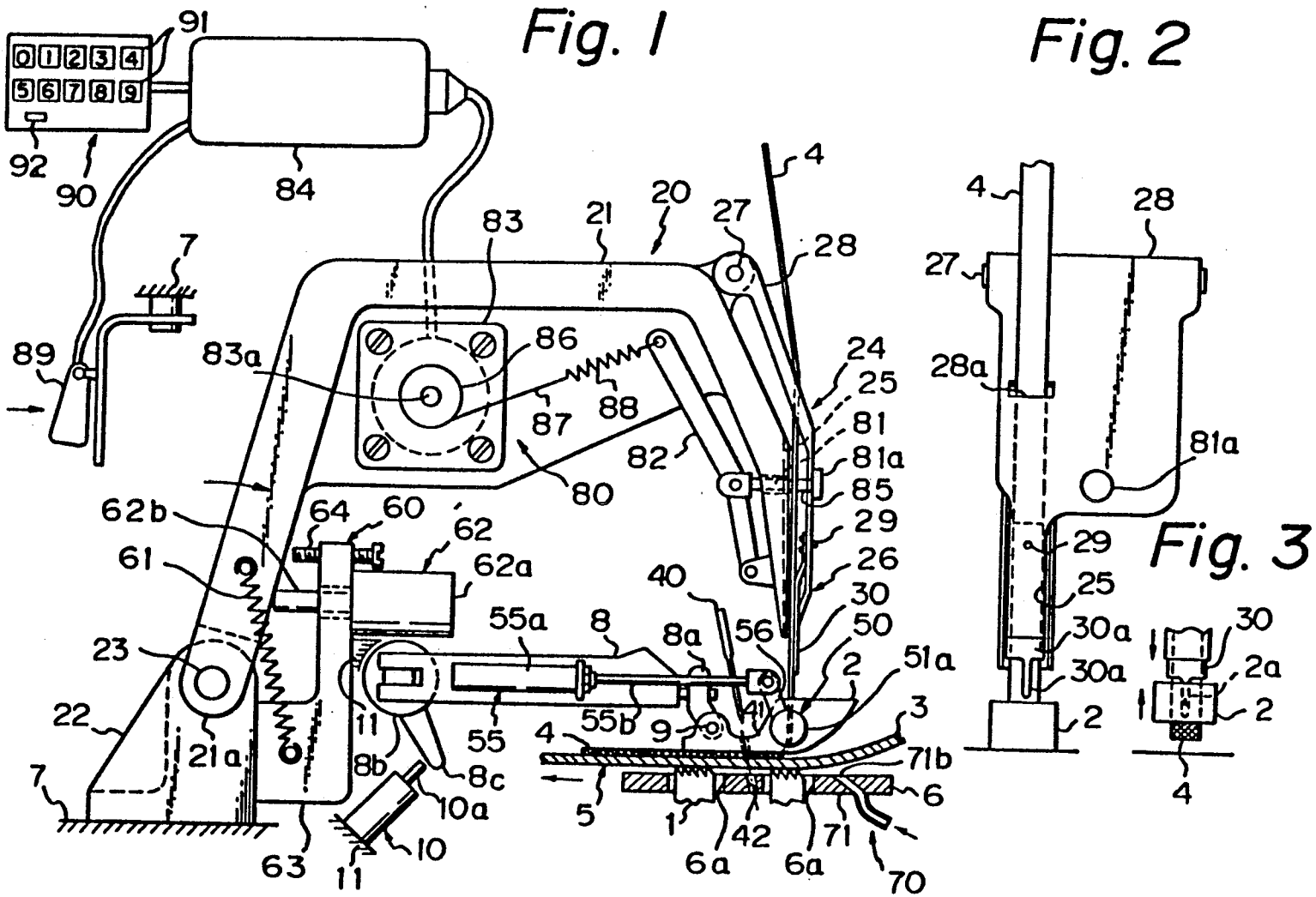
FIG. 1 is a front view of an overlock sewing machine, according to one embodiment of the present invention.
FIG. 2 is a right side view of FIG. 1.
FIG. 3 is a portion of FIG. 2 to illustrate tape feeding action.

Referring now to FIG. 1, an elastic tape sewing machine, according to the present invention, includes feed teeth 1 and a presser foot 2 opposed to the feed teeth 1. Between the feed teeth 1 and the presser foot 2, a combined body 5 formed by a fabric 3 and an elongated elastic tape 4 to be sewn onto the fabric is arranged. The sewing machine according to the present invention is shown as an overlock sewing machine to sew the elastic tape 4 to tubular end of clothes, e.g., wrist band. However, it is not limited to such use and can be applied to sew an elastic tape to a flat fabric or to sew a band-like body to fabric.

The feed teeth 1 perform conventional feed motion through an opening 6*a* of a feed plate 6 to feed the combined body 5 to a direction shown by arrow in FIG. 1. The feed plate 6 is secured to a table 7 which is secured to a frame 11 of the sewing machine. In the embodiment shown, the presser foot 2 is pivotably mounted at the rear end by a pin 9 to one end 8*a* of a link 8. The link 8 is pivotably mounted to the frame 11 at position 8*b* to contact and release the combined body 5. The presser foot is urged clockwise by a biasing spring, not shown, to normally urge the presser foot against combined body 5. The other end 8*c* of the link 8 is engaged to a link drive means, e.g., one end of a piston 10*a* of an air cylinder 10. The air cylinder is mounted to the frame 11 of th sewing machine.

When the piston 10*a* is extended from the position shown in FIG. 1, the link 8 rotates counterclockwise to release the presser foot 2 from the combined body 5 against the spring. When the piston 10*a* contracts the presser foot urges the combined body 5 by the spring to the feed plate 6 and the feed teeth 1 with suitable pressure. The presser foot 2 includes an elastic tape through-hole 12 through which the elastic tape passes vertically through the front end of presser foot as shown in FIG. 4.

A supply device 20 feeds the elastic tape 4 to the through-hole 12 of the presser foot 2 and includes a body 21. A base 21*a* of the body 21 is pivotably supported by a horizontal shaft 23 on a support body 22 which is secured to the table 7. At the free end of the body 21, a retaining means 24 is provided to retain the elastic tape 4. The retaining means 24 is formed at the free end of the body 21 and is formed by a guide groove 25 receiving smoothly the elastic tape 4, and an urging assembly 26 which urges the elastic tape 4 which is received in the groove 25 by suitable urging force. The urging assembly 26 is formed by an arm 28 which is pivotably supported by pin 27 to the body 21 at one end, and an elastic body 30 which is mounted by a screw 29 to the other end of the arm. The other end of the elastic body 30 makes contact with the elastic tape which is received in the guide groove 25 by suitable pressure to retain the elastic tape in the guide groove 25. In this state, when strong force is applied axially to the elastic tape, the elastic tape can slide in the guide groove. Further, the arm 28 includes a slot 28*a* to pass the elastic tape as shown in FIG. 2.

The elastic tape 4 is fed from a bobbin, not shown, which winds the elastic tape, it then passes through the retaining means 24 and the elastic tape through-hole 12 of the presser foot 2, and is fed between the presser foot and the feed teeth, i.e., between the lower surface of the presser foot and the upper surface of the fabric.

The elastic tape 4 is sewn by a needle 40 to the fabric. The needle 40 is conventional and supports a thread, not shown, and is vertically driven by a drive means, not shown. When sewing, the sewing needle passes through a hole 41 in the presser foot 2, the elastic tape 4, the fabric and a needle hole 42 in the feed plate 6.

Figure 4A:
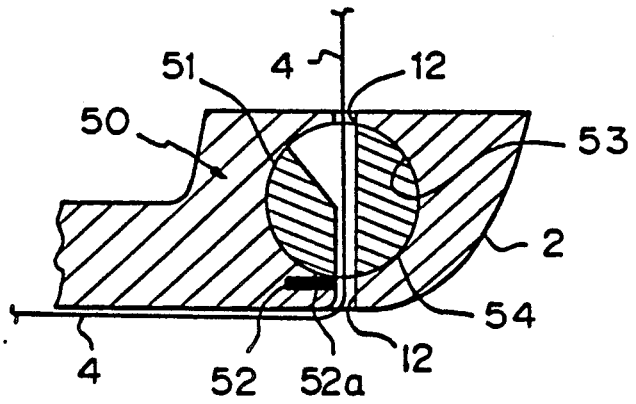
FIG. 4*a* shows the sewing condition and FIG. 4*b* shows the tape cutting condition.
Figure 4B:
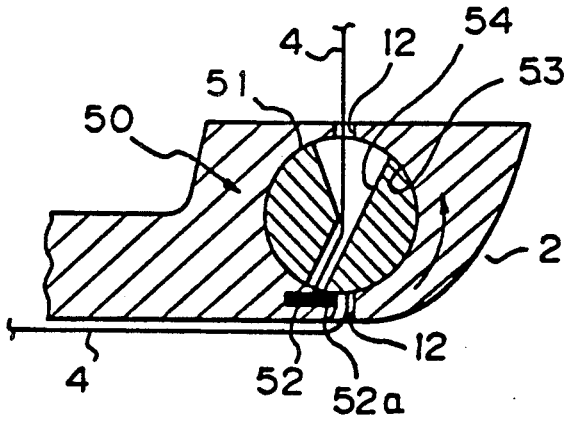

A cutting device 50 cuts the elastic tape after a predetermined length of the elastic tape is sewn to the fabric. The cutting device 50 is arranged in the elastic tape through hole 12 of the presser foot 2. As shown in FIG. 4, the cutting device 50 is formed from a circular movable blade 51 and a fixed blade 52. The movable blade 51 is rotatably received in a hole 53 which is formed midway in the through-hole 12. The movable blade 51 forms a through-hole 54 which can be aligned with the through hole 12. Thus, as shown in FIG. 4*a*, at first, the elastic tape passes from the upper surface of the presser foot 2 into the through-hole 12 and through the through-hole 54 and again through the through hole 12 to the lower surface of the presser foot 2. The fixed blade 52 is fixed to the presser foot 2 generally tangentially to the movable blade 51. As shown in FIG. 4*a*, the fixed blade 52 has a knife edge portion 52*a* which opposes the elastic tape 4 exiting from the through holes 54 and 12. As shown in FIG. 1, the movable blade 51 has a projection 51*a* projected from the hole 53 to connect to a drive means. The drive means is formed by an air cylinder 55 in the illustrated embodiment. A cylinder portion 55*a* of the air cylinder 55 is mounted on the link 8, and an outer end of a piston rod 55*b* is connected to the projection 51*a* through a connecting lever 56. When the piston rod 55*a* extends from the position shown in FIGS. 1 and 4*a*, the movable blade 51 rotates clockwise shown in FIG. 4*a* to a position shown in FIG. 4*b*. By the rotation, the elastic tape is cut by the fixed blade 52. When the piston rod 55*b* contracts, the movable blade 51 rotates counterclockwise in FIG. 4*b* to return to the position shown in FIG. 4*a*.

Thus, the elastic tape is cut in the presser foot so that the elastic tape can be cut near the needle. To cut the elastic tape as near to the needle as possible, the fixed blade is positioned near the lower surface of the presser foot.

After the elastic tape is cut in the presser foot 2, in order to sew the end of the elastic tape connected with the supply device 20 again to the fabric, the end of the elastic tape should be fed to a position which is projected and extended from the lower surface of the presser foot 2. This is done by rotating and urging the body 21 toward the presser foot 2. A drive mechanism 60 rotates the body 21 toward and from the presser foot 2 as shown in FIG. 1. In the illustrated embodiment, the drive mechanism 60 includes a spring 61 which urges the body 21 toward the presser foot 2, and an air cylinder 62 which rotates the body 21 from the presser foot 2 against the spring force. A cylinder portion 62*a* of the air cylinder 62 is mounted on a frame 63 which is secured to the support body 22. A free end of a piston rod 62*b* of the air cylinder 62 is positioned to be engageable with the body 21. One end of the spring 61 is fixed to the body 21 and the other end is fixed to the frame 63. Thus, when the piston rod 62*b* contracts from the position shown in FIG. 1, the body 21 rotates clockwise as shown by arrow in FIG. 1 by the force of the spring 61 so that the free end of the body 21 moves toward the presser foot 2 and the cut end portion of the elastic tape 4 which is supported by the retaining means 24 projects from the lower surface of the presser foot 2. When the piston rod 62*b* extends, the body 21 moves from the presser foot 2.

Further, when the free end of the body 21 moves toward the presser foot 2 to project the end of the elastic tape 4 from the lower surface of the presser foot 2, a free end 30*a* of the elastic body 30 fits in a groove 2*a* of the presser foot 2. Thus, the free end 30*a* of the elastic body 30 guides the elastic tape to insert the elastic tape easily into the elastic tape through-hole 12. A stopper 64 shown in FIG. 1 is mounted on the frame and limits the clockwise rotation of the body 21.

After the cut end of the elastic tape is projected from the lower surface of the presser foot, a guide device 70 shown in FIG. 1 guides the projected end between the presser foot and the feed teeth, i.e., sewing ready position. The guide device 70 is formed by an air nozzle 71 and an air supply source, not shown, to feed pressurised air to the air nozzle 71. Air outlets 71*b* of the nozzle 71 inject air toward the outlet of the elastic tape through-hole 12. The air nozzle acts to let the cut end of the elastic tape move along the feed direction of the fabric. When the presser foot is in an upward position, the air nozzle injects pressurised air.

A regulating device 80 regulates the elastic tape retaining force of the retaining means 24. The regulating device 80 includes a shaft 81 which engages with the arm 28 at one end, a lever 82 pivotably connected with the body 21 at one end and is pivotably connected by the other end of the arm at intermediate portion, a stepping motor 83 connected with the other end of the lever 82, and a controller 84 to control the stepping motor 83. The shaft 81 passes through the body 21 and the arm 28, and forms at one end a head 81*a* which engages with the arm 28. Between the arm 28 and the body 21, a coil spring 85 encircles the shaft 81. The coil spring acts to rotate the arm 28 counterclockwise, as shown in FIG. 1. An output shaft 83*a* of the stepping motor 83 has a pulley 86 which is wound by one end of a wire 87 the other end thereof which is connected through a spring 88 with the other end of the lever 82.

The controller 84 controls the rotation angle of the stepping motor 83, and includes well-known micro-computer, not shown, which performs memory, operation and input and output function. The controller is operated through switches 89 on the sewing machine table and switches 91 on a keyboard 90.

By rotation of the stepping motor 83, the lever 82 rocks through the wire 87 and the spring 88, to move the arm 28 toward and from the body 21. Thus, the elastic tape retaining force of the elastic body 30 can be precisely regulated.

The controller 84 is constructed as follows: The controller can set and store a plurality of position information or data to control the rotation angle of the stepping motor previously as desired. Then, afterward, the position information can be indexed and read out by operator one by one. Or if a plurality of such position information and order is to be read out, the position information or data is first stored as reference information, and then the read-out information is changed and controlled by the operations of the switch 89. That is, ten position informations corresponding to ten keys 91 of 0–9 on the keyboard 90 are stored in the first memory portion in the micro-computer previously so that when a switch 92 is set as input mode and when first No. 2 key of the keys 91 is pushed and then secondly the switch 89 is pushed, position information of program No. 2 is read out from the first memory portion and is written in a second memory portion. Similarly, when first No. 8 key of the keys 91 and then secondly the switch 89 are pushed, position information of program No. 9 is written in the second memory portion next to the aforementioned position information of No. 8. Following this, the switch 92 changes to the practice mode, so that the writing operation is prohibited and now the first piece of position information written in the program No. 2 can be read out from the second memory portion and the stepping motor 83 operates in response to this position information.

Following this operation, when the switch 89 is pushed, the position information of program No. 9 which has been written as the second piece of information on the second memory portion is read out from the second memory portion and the stepping motor 83 rotates and stops at a predetermined position in response to that position information. After that, the order of position information read out from the second memory portion is controlled by the order of input order by every operation of the switch 89.

When the switch 92 is input mode, and the key 89 is pushed while No. 1 and 6 keys 91 are pushed simultaneously, information or data written in the second memory portion is erased. Thus, new position information or data can be read out from the first memory portion and can be written in the second memory portion.

In the above mentioned construction, the elastic tape 4 is guided through the slot 28*a* of the arm 28, the guide groove 25 of the body 21, and the cutting device 50 in the presser foot 2, to the lower surface of the presser foot 2 to be sewn to the fabric by the needle 40 holding upper thread.

In this case, the elastic tape 4 has frictional resistance applied to it by the free end of the body 21 and the elastic body 30. Thus, the elastic tape 4 is elongated corresponding to the frictional resistance and is sewn to the fabric. The frictional resistance applied to the elastic tape 4 is changeable by the rotation angle of the stepping motor 83. The rotation angle can be switched to a plurality of steps by the controller 84, and the position and order thereof can be previously programmed as desired, and further, the switching of the rotation angle by the operator operating the switch 89 can be performed even while sewing is in process. For example, although the order of the three positions of the rotation and stop position have been previously selected and set, by every operation of the switch 89 these three stop position of the stepping motor can be changed.

After sewing, the sewing machine drive pedal is operated to operate the air cylinders 55, 10 and 62 sequentially. Thus, by operation of the air cylinder 55, the elastic tape 4 is cut, as shown in FIG. 4*b*. Then, by operation of the air cylinder 10, the presser foot 2 moves upward to release urging force to the elastic tape and the fabric. Then, by operation of the air cylinder 62, the body 21 rotates clockwise from the position shown in FIG. 1, until the body 21 engages with the stopper 64 so that the elastic tape retained between the free end of the body 21 and the elastic body 30 is fed into the through-hole 12.

As the elastic tape 4 is fed, the cut end thereof projects from the lower surface of the presser foot. When the presser foot 2 is raised, air is injected from the air nozzle 71 so that portion of the elastic tape 4 projected from lower surface of the presser foot 2 is bent by the air pressure along the lower surface of the presser foot, as shown in FIG. 4*a*. When the presser foot 2 is lowered, the elastic tape 4 is urged between the feed teeth and the lower surface to enable the next sewing action.

Figure 5:
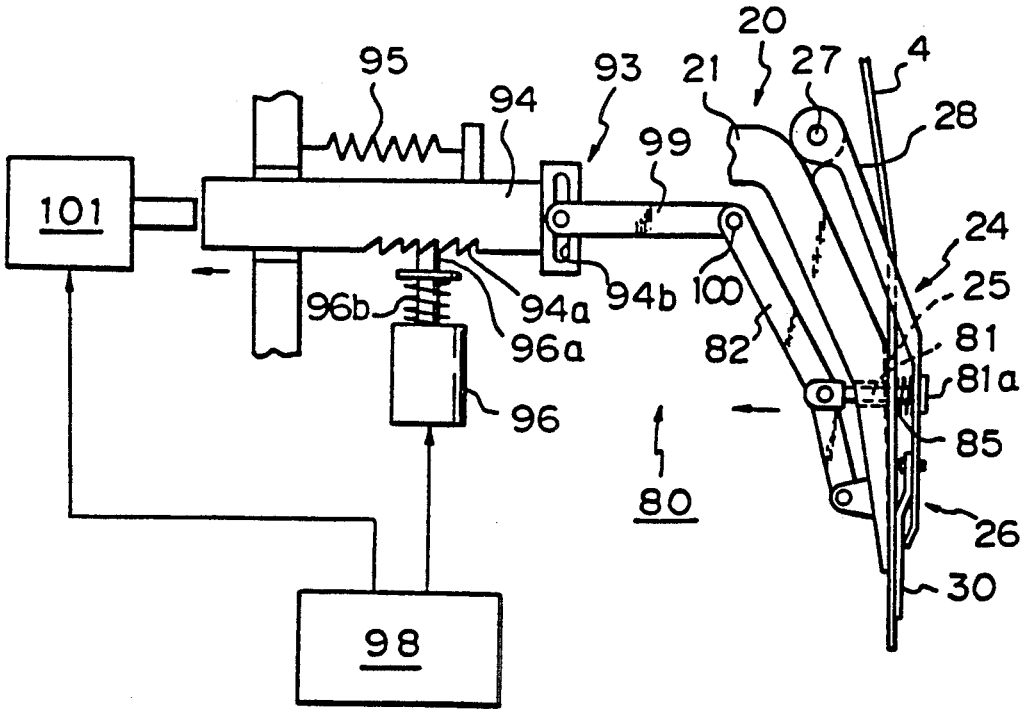
FIG. 5 is an illustration to show a second embodiment of regulating apparatus.

FIG. 5 shows another regulating device 80' which regulates the spring action of the elastic body 30, i.e., the retaining force of the elastic tape 4 by the elastic body 30. The regulating device 80' includes an intermittent motion mechanism including an operation shaft 94 having saw teeth 94*a*, a stepping spring 95 urging the operation shaft 94 in the direction of arrow shown in FIG. 5, and a stepping solenoid 96 having a finger 96*a* engageable with the saw teeth 94*a*, and a controller 98.

One end of the operation shaft 94 has a slit 94*b* which extends normally to the axis of the operation shaft. One end of a link element 99 is movably connected with the slit, and the other end thereof is pivotably connected with the other end of a lever 82 through a pin 100 to rock the lever 82 by the operation shaft 94.

When operational, the stepping solenoid 96 draws the finger 96*a* to release the saw teeth 94*a* against the force of the return spring 96*b*. When the stepping solenoid is deenergized by the spring force of the return spring 96*b*, the finger 96*a* engages with the saw teeth 94*a*.

The controller 98 applies a pulse signal to the stepping solenoid 96 to operate the stepping solenoid at intervals, and includes a micro-computor to set operation numbers of the stepping solenoid 96 as desired.

The other end of the operation shaft 94 has a return solenoid 101 which is operated by the controller 98 to return the operation shaft 94 against the spring force of the stepping spring 95 to its original position in a revers direction to that of the arrow shown in FIG. 5.

When the controller 98 operates the stepping solenoid 96, the finger 96*a* repeatedly moves back and forth to move the operation shaft 94 by the stepping spring 95 and so that each one tooth of the saw teeth 94*a* rotates the lever 82 counterclockwise shown in FIG. 5 through the link element 99.

When the controller 98 selects a high number of operations for the stepping solenoid 96, the movement of the operation shaft 94 in the direction of arrow shown in FIG. 5, i.e., counterclockwise rotation of the lever 82 in FIG. 5. becomes large, so that the arm 28 moves nearer to the body 21 to increase the spring force of the elastic body 30 such that the elastic tape retaining force by the elastic body 30 is increased. When the number of operations of the stepping solenoid is set less, the shaft 81 moves the arm 28 slightly to towards the body 21 so that the spring force of the elastic body is less and the elastic tape is retained by the elastic body 30 by a smaller force. Consequently, the elastic tape retaining force exerted by the elastic body 30 can be precisely regulated.

Further, though not shown in the drawing, an intermittent motion mechanism, a feed pawl operated by a solenoid may rotate a ratchet wheel at intervals. In this case, a controller controlling the solenoid has ratchet wheel rotation angle information which is previously set and stored. A drum concentric with the ratchet wheel winds the wire 87 shown in FIG. 1. In this case, when the controller operates the solenoid, the ratchet wheel rotates at intervals by the feed pawl to pull the wire 87 to rock the lever 82 so that the elastic tape retaining force exerted by the elastic body 30 can also be precisely regulated.

I claim:

1. An elastic tape sewing machine having feed means for feeding a combined body of a fabric and an elastic tape, sewing means for sewing the elastic tape onto the fabric while the fabric and the elastic tape are engaged by said feed means, presser foot means for holding the combined body of the fabric and the elastic tape in engagement with said feed means, elastic tape supply means for supplying elastic tape to said presser foot, said elastic tape supply means including retainer means for retaining the elastic tape by applying a spring force against the elastic tape with an elastic body and for feeding the elastic tape to said presser foot, guide means for guiding the elastic tape fed from said elastic tape supply means to a sewing-ready position between said presser foot means and said feed means, and cutting means for cutting the elastic tape, said machine characterized by:

said retainer means including tape tension regulating means for regulating a tension in the elastic tape, said tape tension regulating means having an intermittent motion means for regulating the spring force applied against the tape by the elastic body and a controller for controlling a number of motions of the intermittent motion mechanism.

2. An elastic tape sewing machine comprising:

feed means for feeding a combination of elastic tape and fabric;

a presser foot movable toward and away from said feed means to hold said combination between said presser foot and said feed means;

a supply device for feeding the elastic tape to said presser foot;

a clamping means for applying a clamping force to the elastic tape fed by said supply device;

a regulating mechanism for regulating the clamping force applied to the elastic tape by said clamping means;

a controller for controlling said regulating mechanism;

said regulating mechanism including a stepper motor;

said stepper motor causing the clamping force applied to the elastic tape to change as a function of a rotation angle of said stepper motor;

said controller including control means for indicating the rotation angle of the stepper motor.

3. An elastic tape sewing machine according to claim 2, in which said controller further includes a memory portion for storing position information which controls the rotation angle of said stepper motor, said control means including means for reading out position information from said memory portion whereby said stepper motor is rotated in response to read out position information.

4. An apparatus for use in sewing elastic tape to fabric, said apparatus comprising means for positioning the elastic tape on the fabric, tape tensioning means for tensioning the elastic tape with any one of a plurality of tape stretching forces, and means for sewing the elastic tape to the fabric while a selected one of the plurality of stretching forces is present in the elastic tape, said tape tensioning means including clamp means for applying a clamping force against the elastic tape, control means for varying the clamping force applied against the elastic tape by said clamp means, said control means including data storage means for storing data corresponding to a plurality of clamping forces, selector means connected with said data storage means for use in selecting data corresponding to any one of the plurality of clamping forces, and actuator means for effecting operation of said clamp means to change the clamping force applied against the elastic tape in response to actuation of said selector means to select the data corresponding to a clamping force different than the clamping force applied against the elastic tape by said clamping means.

5. An apparatus as set forth in claim 4 wherein said actuator means includes an electric motor having an output member movable to any one of a plurality of positions each corresponding to a different clamping force, said selector means including means for effecting operation of said electric motor to a position corresponding to a selected clamping force.

6. An apparatus as set forth in claim 4 wherein said clamp means includes a clamp member having a surface engagable with the elastic tape, said actuator means including spring means connected with said clamp member and resiliently deformable to any one of a plurality of extents to press said surface on said clamp member against the elastic tape with any one of a plurality of spring forces each corresponding to a different extent of deformation of said spring means, and motor means connected with said spring means, said motor means operable to any one of a plurality of operating conditions to resiliently deform said spring means to any one of the plurality of extents, said selector means including means for effecting operation of said motor means to an operating condition wherein said spring means is resiliently deformed to an extent corresponding to a clamping force the same as the clamping force corresponding to the selected data.

* * * * *